US011578458B2

(12) United States Patent
Hunter et al.

(10) Patent No.: US 11,578,458 B2
(45) Date of Patent: Feb. 14, 2023

(54) SYNTHETIC ROPE

(71) Applicant: BRIDON INTERNATIONAL LIMITED, Doncaster (GB)

(72) Inventors: Timothy Hunter, Glasgow (GB); Pengzhu Wang, Doncaster (GB)

(73) Assignee: BRIDON INTERNATIONAL LIMITED, Doncaster (GB)

( * ) Notice: Subject to any disclaimer, the term of this patent is extended or adjusted under 35 U.S.C. 154(b) by 0 days.

(21) Appl. No.: 16/967,800

(22) PCT Filed: Feb. 12, 2019

(86) PCT No.: PCT/EP2019/053422
§ 371 (c)(1),
(2) Date: Aug. 6, 2020

(87) PCT Pub. No.: WO2019/170373
PCT Pub. Date: Aug. 12, 2019

(65) Prior Publication Data

US 2021/0040687 A1 Feb. 11, 2021

(30) Foreign Application Priority Data

Mar. 6, 2018 (EP) ..... 18250009

(51) Int. Cl.
*D07B 1/02* (2006.01)
*D07B 1/16* (2006.01)

(52) U.S. Cl.
CPC ..... *D07B 1/025* (2013.01); *D07B 1/165* (2013.01); *D07B 2201/1096* (2013.01);
(Continued)

(58) Field of Classification Search
CPC ..... D07B 1/025; D07B 1/165; D07B 1/167; D07B 2201/2048; D07B 2201/2049
See application file for complete search history.

(56) References Cited

U.S. PATENT DOCUMENTS 1,183,487 A * 5/1916 Parker ..... D07B 1/068 57/219
1,868,681 A 7/1932 Wyatt
(Continued)

FOREIGN PATENT DOCUMENTS

EP 0 652 989 7/1998
EP 2 669 426 12/2013
(Continued)

OTHER PUBLICATIONS

International Search Report dated May 9, 2019 in International (PCT) Application No. PCT/EP2019/053422.
(Continued)

*Primary Examiner* — Shaun R Hurley
(74) *Attorney, Agent, or Firm* — Wenderoth, Lind & Ponack, L.L.P.

(57) ABSTRACT

A synthetic rope (20) comprises a core (22) and at least a first layer surrounding the core (22). The first layer has first layer strands (26). The core has a fluted outer surface with spaced apart helical concave grooves. Each of these grooves contacts one of the first layer strands (26). The grooves have a radius of curvature (24) that is greater than the radius of curvature (14) of a circle having a same diameter as the contacting first layer strand before twisting.

13 Claims, 2 Drawing Sheets

(52) U.S. Cl.
CPC ..... *D07B 2201/209* (2013.01); *D07B 2201/2044* (2013.01); *D07B 2201/2049* (2013.01); *D07B 2201/2053* (2013.01); *D07B 2201/2057* (2013.01); *D07B 2201/2065* (2013.01); *D07B 2201/2068* (2013.01); *D07B 2201/2074* (2013.01); *D07B 2401/207* (2013.01)

(56) References Cited

U.S. PATENT DOCUMENTS 1,916,135 A * 6/1933 Gates ..... D07B 1/0686 57/220
2,136,865 A * 11/1938 Reed ..... D07B 1/0686 57/220
2,136,867 A * 11/1938 Reed ..... D07B 1/165 57/220
2,184,502 A * 12/1939 Metcalf ..... D07B 1/0686 57/241
2,991,615 A 7/1961 Stanton
3,018,607 A * 1/1962 Dietz ..... D07B 1/0673 57/214
3,603,715 A * 9/1971 Eilhardt ..... H01B 12/06 174/15.5
4,050,230 A * 9/1977 Senoo ..... D07B 1/165 57/231
4,120,145 A * 10/1978 Chiappetta ..... D07B 1/0673 57/221
4,778,246 A * 10/1988 Carroll ..... D07B 1/167 385/107
4,936,647 A * 6/1990 Carroll ..... D07B 1/068 174/128.1
5,141,796 A * 8/1992 Harvey ..... D07B 1/147 138/123
5,269,128 A 12/1993 Walton et al.
5,797,254 A 8/1998 Walton
6,412,264 B1 * 7/2002 De Josez ..... B66B 7/06 57/217
6,855,889 B2 * 2/2005 Gareis ..... H01B 11/06 174/113 C
6,943,300 B2 * 9/2005 Ekeberg ..... H01B 7/045 174/113 C
7,518,058 B1 * 4/2009 Hagbrandt ..... H02G 3/02 174/113 C
8,943,789 B2 * 2/2015 Takeuchi ..... D07B 1/0686 57/220
9,708,758 B2 * 7/2017 Amils ..... D07B 5/00
2002/0028112 A1 * 3/2002 Paulshus ..... D07B 1/142 405/224.2
2006/0193698 A1 * 8/2006 Mjelstad ..... D07B 1/167 405/195.1
2012/0005998 A1 * 1/2012 Noguchi ..... D07B 1/165 57/258
2013/0318937 A1 * 12/2013 Takeuchi ..... D07B 5/007 57/220
2017/0328001 A1 * 11/2017 Kirth ..... D07B 1/025
2020/0168365 A1 * 5/2020 Hirose ..... H01B 13/0006

FOREIGN PATENT DOCUMENTS

GB 2 320 933 7/1998
WO 2004/020732 3/2004

OTHER PUBLICATIONS

McKenna et al., "Handbook of fibre rope technology", The Textile Institute, Woodhead Publishing Ltd., Jan. 1, 2004, pp. 18-21 and 208-211, cited in ISR.

* cited by examiner

SYNTHETIC ROPE

TECHNICAL FIELD

The invention relates to a synthetic rope, and more particularly, to a synthetic rope where the load-bearing elements are man-made synthetic fibres of polymer origin.

BACKGROUND ART

High demands are put on synthetic ropes that are designed, for example, for use on winches and cranes. The breaking load is expected to increase as well as the radial stiffness and the load shearing and strength conversion efficiency. As a result, attempts are being made to improve the fill factor. Higher fill factors or higher packing factors, however, lead to increased radial contacts of the various elements in a rope. These increased radial contacts may ultimately lead to increased abrasion and increased fretting and consequently reduced fatigue resistance.

U.S. Pat. No. 1,868,681 discloses a rope comprising a plurality of strands of flexible material like Manila hemp fibres around a rubber core. The rubber core increases the elasticity of the rope and extends the life of the rope by cushioning and protecting the fibres.

DISCLOSURE OF INVENTION

It is a general object of the invention to avoid the drawbacks of the prior art.

It is a particular object of the invention to improve the life time of a synthetic rope.

It is a specific object of the invention to decrease interaction along radial direction between elements in a synthetic rope.

According to the invention, there is provided a synthetic rope comprising a core and at least a first layer surrounding the core. The first layer has first layer strands. The core has a fluted outer surface with spaced apart helical concave grooves. Each of the grooves contacts one of the first layer strands. The radius of curvature of the grooves is greater than the radius of curvature of a circle having the same cross-section as the cross-section of a first layer strand.

The terms "synthetic rope" refer to a rope where the strength or load-bearing elements are synthetic fibres, preferably man-made synthetic fibres of polymer nature or carbon fibres or basalt fibres.

The use of this fluted core with concave grooves has the advantage of reducing wear between and within the various first layer strands.

A fluted core with helical concave grooves is known in the prior art of steel wire ropes. U.S. Pat. No. 5,269,128, EP-B1-0 652 989, U.S. Pat. No. 5,797,254 and GB-A-2 320 933 (all of Bridon plc) disclose various embodiments of a fluted core member with helical grooves. The round steel strands of the steel wire ropes are accommodated in the groves. The profile of the grooves conforms closely to the shape of the steel strands and maximizes the area of contact with the steel strands. Applying this prior art type of fluted core member, however, would decrease the cross-section area available for load bearing fibres.

According to a particular embodiment of the invention, the fluted core comprises convex curves between the concave grooves.

The Core

The core is not hollow and, preferably, the core comprises a core load bearing member and, such as an independent fibre rope core (IFRC) which is equivalent to an independent wire rope core (IWRC) in wire ropes and, most preferably, a core cover such as sheathing. As this preferable embodiment of the core is also load bearing, this further increases the breaking load and tensile strength of the synthetic rope.

The core with the fluted geometry is preferably made in advance, prior to the rope manufacturing. This means that the presence of the concave grooves is not the result of the core material flowing as a result of the surrounding layer strands. Instead the grooves provide a solid basis for the surrounding layer strands to avoid them from chafing against each other.

Suitable materials for the core are polymers like polypropylene, polyethylene and polyester or an elastomer. Polyeolefins, high density polyethylene, polypropylene and polyethylene copolymers are preferred as they provide more strength to the core.

Extruded Layer

In a preferable embodiment of the invention, this core sheathing is an extruded layer.

The material of the extruded layer may be a homopolymer or a copolymer;

a thermoplastic (plastomer), an elastomer and a thermoplastic elastomer, for example polyester copolymer under the commercial name of HYTREL® and ARNITEL® and ethylene octane copolymer under the commercial name of EXACT®.

The core load bearing member may be a synthetic strand or a synthetic rope.

This synthetic strand may be a braided construction, which has the advantage of being torsion free.

This synthetic strand may also be a wire laid strand, which has the advantage of providing a higher strength and a higher fatigue resistance.

The load bearing member inside the core may also be a solid cylindrical or tubular member. This tubular member may be made of a material that is harder than the material of the extruded layer so that it provides more stiffness to the core.

Alternatively, the load bearing core member may be an extruded fluted core of single solid polymer material having grooves with a radius of curvature as described above. The solid core may have an orientated structure which comprised elongated crystals orientated in the axial direction of the core.

The synthetic rope according to the invention may have a second layer surrounding the first layer. The synthetic rope may also have a third layer surrounding the second layer.

The second layer may comprise second layer strands. The third layer may comprise third layer strands. Some of the first layer strands, second layer strands or third layer strands each may have a braided or extruded strand cover. This strand cover has the advantage of compacting the enveloped strands and of mitigating abrasion with neighbouring strands.

As alternative to the braided or extruded strand cover on some or all of the first layer strands, second layer strands or third layer strands, or in addition to this braided or extruded strand cover, the first layer as a whole, the second layer as a whole (if any) and the third layer as a whole (if any) may have a braided or extruded layer cover. This layer cover has the advantage of compacting the enveloped layers and of mitigating fretting between successive layers.

The synthetic rope according to the invention comprises synthetic fibres.

Synthetic Fibre

The invention is applicable for all types of synthetic fibres of polymer nature currently used in ropes. Examples of such fibres are polyamide fibres, polyester fibres, polyolefin fibres such as polypropylene and polyethylene fibres, and particularly high strength synthetic fibres such as high strength polypropylene (HSPP), high modulus polyethylene (HMPE) also known as ultra high molecular weight polyethylene (UHMwPE), para-aramid fibres such as poly(P-phenylene terephthalamide) (PPTA) fibres, liquid crystal polyester (LCP/LCAP), poly(P-phenylene-2,6-benzobisoxazole) (PBO), meta-aramid fibres such as poly (m-phenylene isophthalamide fibres, copolyamide fibres of (terephthaloyl chloride, P-phenylenediamine, 3,4'-diaminodiphenyl ether), normally referred to as "copolymer aramid").

The polymer materials may be present not only in fibre format but also in other longitudinal format such as a tape, filament and rods.

Various different fibres may also be combined in one assembled yarn, strand and/or in one rope.

BRIEF DESCRIPTION OF FIGURES IN THE DRAWINGS

MODE(S) FOR CARRYING OUT THE INVENTION

Figure 1:
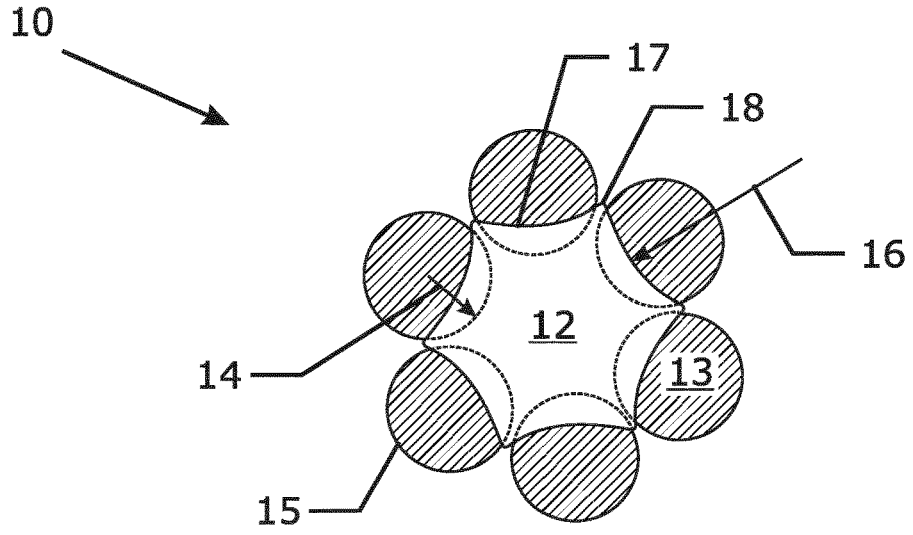
FIG. 1 is a conceptual drawing explaining the difference between a fluted core member of a steel wire rope and a fluted core member of a synthetic rope according to the invention.

Referring to FIG. 1, the difference between a fluted core member of a steel wire rope and a fluted core member of a synthetic rope according to the invention is explained.

Take as starting point a hypothetical steel wire rope 10 having a fluted core member 12 with helical concave grooves, shown in dotted lines. The grooves follow the contours of the round steel wire strands. Each groove has a radius of curvature 14 that is about equal to the radius of the circumscribing circle of the steel strands 15, which is half the so-called tube diameter or equivalent diameter.

On the one hand, for a synthetic rope, this small radius of curvature 14 is not needed, even not desired.

On the other hand, for a synthetic rope a core with only convex parts may need to be avoided to prevent strands from shifting and abrading against one another. The wedge packing of the first layer strands leads to very small radii in the corners of those strands. An objective of the concave curves is to increase these radii.

In contrast with steel ropes, the radius of curvature 16 for the grooves of a fluted core member for synthetic ropes is greater than the radius of curvature 14, e.g. 10% greater, preferably 20% or more preferably 30% or 40% greater than the radius of curvature 14.

A fluted member that is adapted for synthetic ropes is shown in full lines on FIG. 1. Between the equally spaced concave grooves 17, convex parts 18 may be present.

Figure 2:
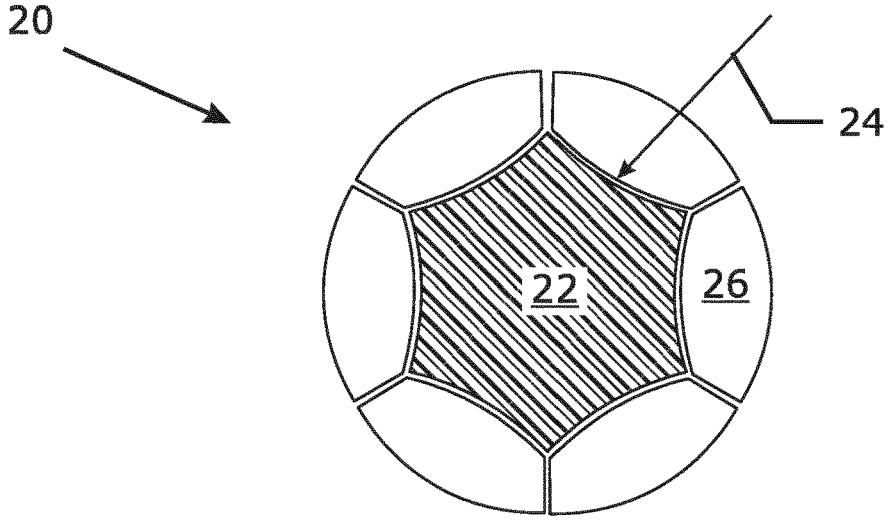
FIG. 2 is a cross-section of a first embodiment according to the invention.

FIG. 2 shows a first embodiment of a synthetic rope 20 according to the invention.

The synthetic rope 20 has a fluted solid core member 22 with spaced apart concave helical grooves with a radius of curvature 24 that is greater than in the case of a steel wire rope. One single layer of first layer strands 26 surrounds the core 22, each first layer strand 26 fits in one concave groove.

Figure 3:
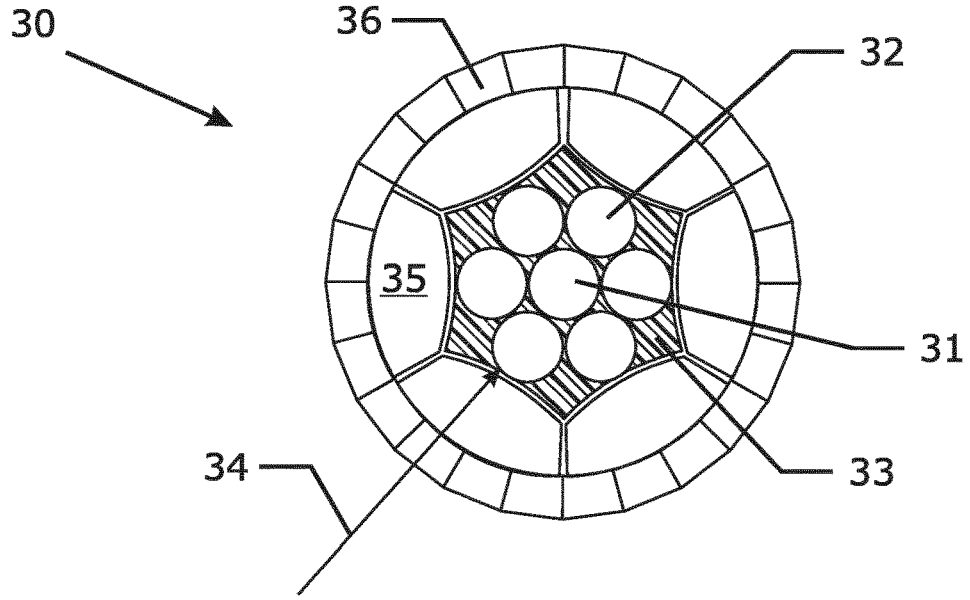
FIG. 3 is a cross-section of a second embodiment according to the invention.

FIG. 3 shows a second embodiment of a synthetic rope 30 according to the invention.

This synthetic rope 30 has a fluted core member with concave spaced apart helical grooves. The core member has a load bearing member in the form of a synthetic strand with a core 31 and a surrounding layer 32 of six synthetic elements. The core 31 and the layer 32 are covered with an extruded layer 33 of a polymer material that gives the grooved shape to the core. The helical shape can be provided either by a rotating extrusion die or by having the fluted core rotating when twisting the surrounding strands. The concave grooves of the core have a radius of curvature 34 that is greater than in case of a steel wire rope; as explained in FIG. 1. A layer of synthetic first layer strands 35 surrounds the core member. Each such strand 35 is accommodated in a groove of the core thereby avoiding shifting of the first layer strands 35 and thus mitigating fretting. A layer of synthetic second layer strands 36 surrounds the first layer.

Figure 4:
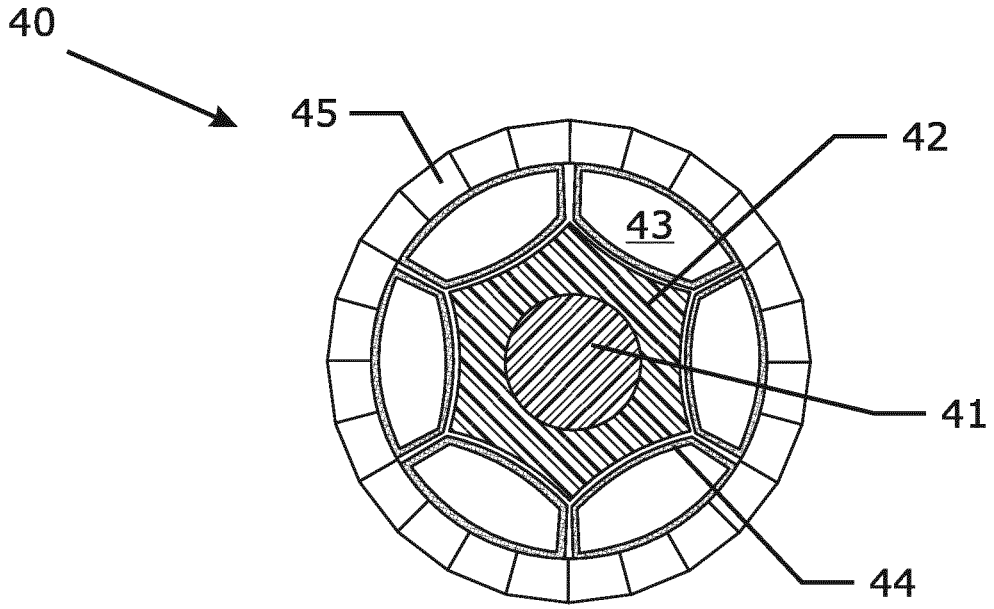
FIG. 4 is a cross-section of a third embodiment according to the invention.

FIG. 4 shows a cross-section of a third embodiment of a synthetic rope 40 according to the invention.

The core of this synthetic rope 40 has a cylindrical member 41 and an extruded layer 42 provided with helical grooves. A layer of synthetic first layer strands 43 surrounds the core. Each first layer strand 43 is enveloped with a braided cover 44. As an alternative to the braided cover 44, an extruded layer may be provided around each first layer strand 43. A layer of synthetic second layer strands 45 surrounds the first layer. Although not shown on FIG. 4, a braided cover or an extruded layer may be provided also around some or all of the synthetic second layer strands 45.

Figure 5:
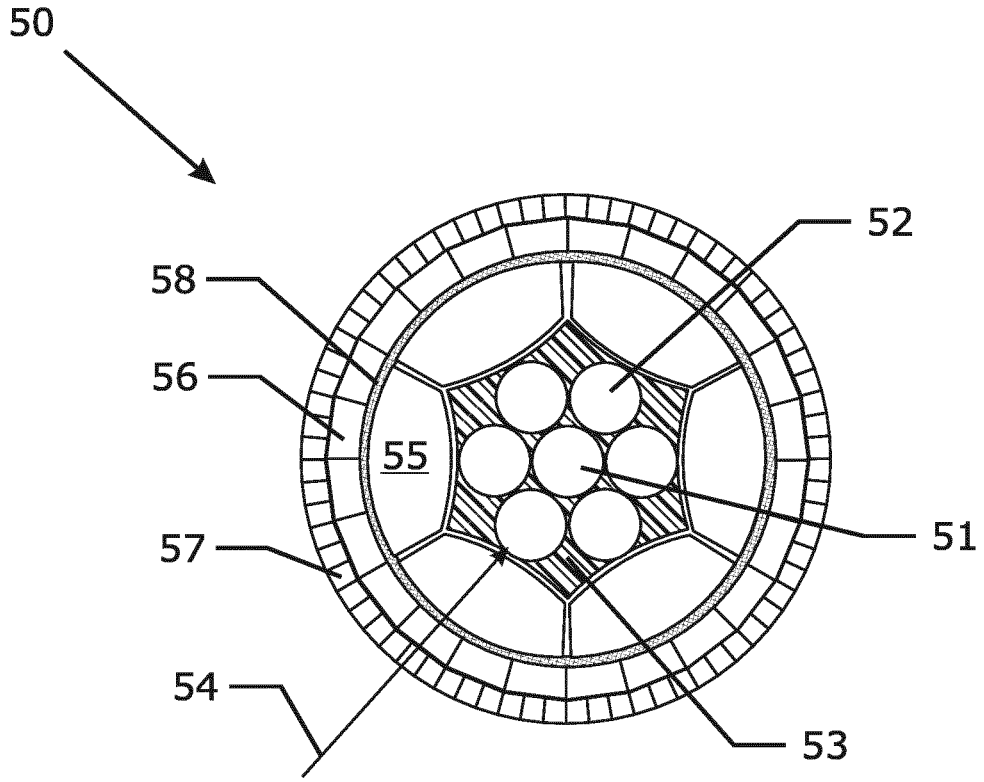
FIG. 5 is a cross-section of a fourth embodiment according to the invention.

FIG. 5 shows a cross-section of a fourth embodiment of a synthetic rope 50 according to the invention.

This synthetic rope 50 has a fluted core member with concave spaced apart helical grooves. The core member has a load bearing member in the form of a synthetic strand with a core 51 and a surrounding layer 52 of six synthetic elements. The core 51 and the layer 52 are coated with an extruded layer 53 of a polymer material that gives the grooved shape to the core. The grooves have a radius of curvature 54 that is greater than in the case of steel wire strands, as explained in FIG. 1. A layer of first layer strands 55 surrounds the core. Each first layer strand 55 fits in a groove of the core. A layer of second layer strands 56 surrounds the first layer and a layer of third layer strands 57 surrounds the second layer. A braided cover 58 envelops the first layer thereby mitigating contact and abrasion between the first layer and the second layer and at the same time keeping torsions of the first layer limited. Instead of a braided cover 58, an extruded layer may be provided around the first layer.

Although not shown on FIG. 5, a braided cover or an extruded layer may also be provided around the second layer.

FIG. 2, FIG. 3, FIG. 4 and FIG. 5 show embodiments of synthetic ropes 20, 30, 40, 50 with one, two or three layers. Each of these layers is shown with a particular number of strands. The invention, however, is not limited to the number of strands shown.

A synthetic rope according to the present invention may be used, for example, on winches and cranes and other pulling and hoisting devices e.g. abandonment and recovery (A&R), knuckle boom crane, riser pull in, riser tensioners, drag shovel hoist, anchor lines and deep shaft hoisting drum and friction winding applications. In these applications, particular demands are placed on a rope as it passes over sheaves and pulleys, is wound under tension onto a drum containing multiple layers or is progressively loaded by friction through a traction drive. The design of the synthetic rope of the present invention enables it to be integrated onto such systems designed for steel wire rope with minimal system modification and reduces internal wear and fretting mechanisms, where duty cycles or tensions are high.

REFERENCE NUMBERS

10 hypothetical rope with cylindrical strands
12 rope core
13 round steel wire strands
14 radius of curvature of circle circumscribing the steel strands
15 circle circumscribing round steel wire strands
16 radius of curvature of invention grooves in core member
17 invention groove
18 convex part between grooves
20 synthetic rope of first embodiment
22 solid core
24 radius of curvature of grooves of solid core
26 first layer strand
30 synthetic rope of second embodiment
31 core of reinforcing core member
32 layer of reinforcing core member
33 extruded layer
34 radius of curvature of groove in extrusion layer
35 $1^{st}$ layer strand
36 $2^{nd}$ layer strand
40 synthetic rope of third embodiment
41 tubular core member
42 extruded layer
43 $1^{st}$ layer strand
44 braided cover surrounding $1^{st}$ layer strand
45 $2^{nd}$ layer strand
50 synthetic rope of fourth embodiment
51 core of reinforcing core member
52 layer of reinforcing core member
53 extruded layer
54 radius of curvature of groove in extrusion layer
55 $1^{st}$ layer strand
56 $2^{nd}$ layer strand
57 $3^{rd}$ layer strand
58 braided cover enveloping the layer of first strands

The invention claimed is:

1. A synthetic rope comprising
a core comprising a load bearing member and a core cover, and
at least a first layer surrounding said core,
said first layer having first layer strands,
said core having a fluted outer surface with spaced apart helical concave grooves,
each of said grooves contacting one of said first layer strands,
said grooves having an actual radius of curvature that is greater than a hypothetical radius of curvature of a circle having the same cross-section as the cross-section of a first layer strand,
said actual radius of curvature being the same throughout an entirety of said grooves,
wherein the load bearing member of the core and the core cover of the core are made from different materials.

2. The synthetic rope of claim 1,
wherein said core comprises convex curves between said concave grooves.

3. The synthetic rope of claim 1,
said core cover being an extruded layer.

4. The synthetic rope of claim 1,
said core load bearing member being a synthetic strand or synthetic rope.

5. The synthetic rope of claim 4,
said synthetic strand being a braided construction.

6. The synthetic rope of claim 4,
said synthetic strand being a wire laid strand.

7. The synthetic rope of claim 1,
said core load bearing member being a solid cylindrical member.

8. The synthetic rope according to claim 1,
said rope comprising a second layer surrounding said first layer.

9. The synthetic rope according to claim 8,
said rope comprising a third layer surrounding said second layer.

10. The synthetic rope according to claim 9, wherein said second layer strands and said third layer comprises third layer strands, some of said first layer strands, second layer strands and third layer strands each have a braided or extruded cover.

11. The synthetic rope according to claim 10, wherein said first layer, said second layer and said third layer may have a braided or extruded cover.

12. The synthetic rope according to claim 9, wherein said first layer, said second layer and said third layer may have a braided or extruded cover.

13. The synthetic rope according to claim 1,
said rope comprising high strength polymer fibres.

* * * * *